US005820003A

United States Patent [19]

Nichols

[11] Patent Number: 5,820,003

[45] Date of Patent: Oct. 13, 1998

[54] HOLSTERS FOR HANDGUNS

[76] Inventor: Richard E. D. Nichols, 13223 Black Mountain Rd., Suite 357, San Diego, Calif. 92129

[21] Appl. No.: 786,840

[22] Filed: Dec. 13, 1996

Related U.S. Application Data

[60] Provisional application No. 60/009,140 Dec. 22, 1995.

[51] Int. Cl.[6] ..... F41C 33/02

[52] U.S. Cl. ..... 224/575; 224/192; 224/677; 224/587; 224/623; 224/666; 224/673; 224/911

[58] Field of Search ..... 224/677, 587, 224/575, 911, 192, 193, 623, 624, 673, 243, 244, 579, 580, 581

[56] References Cited

U.S. PATENT DOCUMENTS 4,022,361 5/1977 Devlin ..... 224/911
4,258,871 3/1981 McMahon ..... 224/911
5,236,113 8/1993 Wisser ..... 224/911
5,282,559 2/1994 Wisser et al. ..... 224/911

*Primary Examiner*—Linda J. Sholl
*Attorney, Agent, or Firm*—Brown, Martin, Haller & McClain, LLP

[57] ABSTRACT

A holster for a handgun includes a pouch for releasably receiving the handgun and an outer panel secured to the pouch with an attachment device for attaching the pouch to a user, such as a belt, waistband, ankle or shoulder harness. The pouch has two side walls secured together at a central wall portion. Rear edge portions of the side walls are secured together by at least one faster which also secures the panel to the pouch. The panel is adapted to pass around the pouch and is also secured to the central wall portion by a second fastener. A strip secured to the central wall portion on the inside of the pouch has a portion covering the inner end of the second fastener.

38 Claims, 11 Drawing Sheets

HOLSTERS FOR HANDGUNS

REFERENCE TO PRIOR PROVISIONAL APPLICATION

This application claims the benefit of Provisional application No. 60/009,140 filed Dec. 22, 1995.

FIELD OF THE INVENTION

This invention relates to holsters for handguns and refers particularly, though not exclusively, to such holsters having an overlying panel to enable the holster to be used in a number of different ways.

BACKGROUND OF THE INVENTION

Traditionally, holsters for handguns have been made specific for an individual handgun or small range of similar handguns. This has required manufacturers of holsters to produce a large range of holsters suitable for the large variety of handguns now available. Of late there has also been the need to have holsters which are able to be used in different ways. For example, there is the traditional form of holster attached to the belt of a wearer which sits "on the hip" of a wearer. Other holsters are attached to the thigh of a wearer; the ankle of a wearer at the back such that the handgun is essentially horizontal; to the waistband or belt of a wearer without the use of belt loops; or to a shoulder harness. With the large range of handguns, and the large range of variations in the way of wearing the holster, manufacturers are required to have a large range of varying holsters.

Furthermore, particularly in police forces, a police officer can change their duties and thus their need in relation to holsters may change. For example, a policeman in uniform requires a holster in the traditional "on-the-hip" position. If that policeman becomes involved in undercover work, a holster to be attached to the belt may be more appropriate. In the past, this would have required a totally new holster.

U.S. Pat. No. 4,750,650 (and others) to Nichols and to Bianchi discloses a holster having a slotted, overlying panel. This is a fixed panel attached with stitching at its perimeters.

In U.S. Pat. No. 5,282,559 of Wisser and Pabst there is disclosed a holster for handguns having a pocket and an external frame. The frame is attached at the rear edge of the pocket only so that the front of the pocket is movable relative to the frame. Furthermore, the pocket is of a relatively flexible material, whereas the frame is of a relatively stiff material so as to provide structural strength due to the pocket having little or no structural strength. Furthermore, a belt loop is required to be a separate component, and attached to the frame only for the "at-the-hip" form of holster. A security strap for the handgun is attached to the frame by use of fasteners and is not readily adjustable by a user.

In view of the inherent lack of rigidity in the pocket, the patentees propose the anti-twist plates are provided in the pocket. There is no disclosure of the ability to change the frame to suit the wearing requirements of the user. This is highlighted in the description of the preferred embodiment in column 6, line 45, where it is disclosed that an adhesive may be used to fasten the frame to the outer layer of the pocket.

In U.S. Pat. No. 769,428 of Brannon there is shown a pistol case which comprises an open-top holster with a belt loop attachment to the holster. The belt loop is attached by use of fasteners. These fasteners are exposed at the inner surface of the holster. This means that the insertion and withdrawal of the handgun may cause the fasteners top rub against the handgun to thus cause damage to the handgun.

It is preferable with holsters for handguns that any fasteners used not be exposed to the surface of the handgun when it is in the holster; or when it is being inserted into, or removed from, the holster.

It is therefore the principal object of the present invention to provide a holster for handguns where the holster has an overlying panel by which a common holster body may be adapted to different applications.

SUMMARY OF THE INVENTION

The invention provides a holster for a handgun comprising:

(a) a pouch adapted to releasably receive therein the handgun, the pouch having,
  (i) a first side wall,
  (ii) a second side wall integral with the first side wall and being joined thereto at a central region,
  (iii) the first and second side walls each having a rear edge portion adapted to be releasably fastened together by the at least one fastener, and (b) a panel adapted to pass around the pouch and to be attached thereto by at least one fastener, and by at least one further fastener located adjacent the central region.

Preferably, there are two of the at least one fasteners, and four of the further fasteners.

Preferably, a sight guard such as disclosed in U.S. Pat. No. 5,161,721 is secured to the inner surface of the pouch at the central region.

Preferably, the sight guard covers the inner ends of the further fasteners to prevent the handgun from contacting those inner ends when in the holster; or being inserted into, or withdrawn from, the holster.

Advantageously, a spacing block is located between the rear edge portions of the first and second walls, the spacing block having an outer edge to correspond in shape to the rear edge portions of the first and second side walls, and an inner edge portion shaped to correspond to the shape of a trigger guard of the handgun; the spacing block being held in position relatively to the outer edge portions of the first and second side walls by the at least one fastener.

More advantageously, there is provided a security strap releasably and adjustably attachable to either of the first and second side walls of the pouch, the security strap being held in place to the respective side wall by the panel when the panel is attached to the pouch.

More preferably, the panel passes around the outer surface of the pouch and has at least one attachment means to enable the holster to be attached to a garment, belt or the like worn by the user in a desired manner.

Advantageously, the attachment means may be selected from any one or more of the following:

(a) belt loops;
(b) a spring clip to be attached to a belt;
(c) a paddle clip to be attached to a waistband or belt;
(d) belt loops for use "at the hip" of a user;
(e) belt loops for attachment to a belt at the back of a wearer;
(f) belt loops for attachment "at the hip" at an angled position;
(g) belt loops for attachment "at the hip" of a wearer in the "pancake" position; and
(h) rings, loops or the like for use with a shoulder harness.

DESCRIPTION OF THE DRAWINGS

In order that the invention may be fully understood there shall now be described by way of preferred and nonlimitative example only preferred constructions of several embodiments of the present invention, the description being with reference to the accompanying illustrative drawings in which.

DESCRIPTION OF THE PREFERRED EMBODIMENTS

Figure 1:
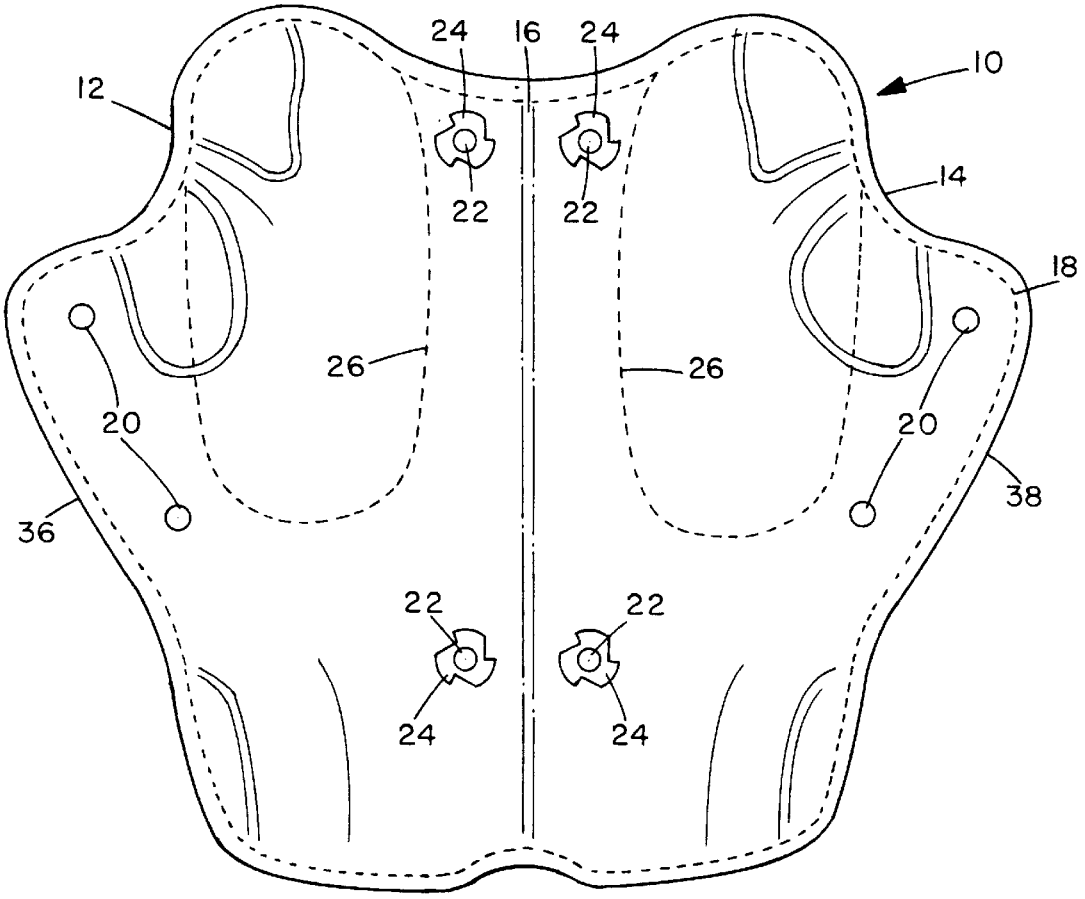
FIG. 1 is a plan view of a cut-out and partially formed pouch according to the present invention.

To refer firstly to FIGS. 1–5, there is shown a pouch generally designated as 10 and which includes a first side wall 12 and a second side wall 14 integrally formed with first side wall 12 and adapted to be folded around a central region 16. The pouch 10 may be formed of any suitable material such as, for example, leather, a synthetic material, a laminate of leathers, a laminate of synthetic materials, or a laminate of leathers and synthetic materials. If in the form of a laminate, the components may be stitched together using peripheral stitching 18. It may be relatively rigid, or of a relatively soft material, if desired. The pouch 10 may be preformed to fit a particular handgun, or left unformed to fit a variety of handguns, as in FIGS. 2 and 3.

As is clear from FIG. 1, each side wall 12,14 has a rear edge portion 36,38 respectively in which are formed holes 20. The spacing and location of holes 20 in each of rear portions 36,38 is important and identical, as will be understood from the following description. Further holes 22 are provided adjacent the central region 16. Those on the first side wall 12 are identically spaced and located to those on the second side wall 14. As with holes 20, the spacing and location of further holes 22 is important. If desired, for holes 22, captive nuts 24 may be used, as will be understood from the following description. However, captive nuts are generally not required for holes 20.

In general, the first side wall 12 and second side wall 14 are substantially identical, with second side wall 14 being a mirror image of first side wall 12. However, there may be variations between the two side walls to allow for the configuration, shape and fittings of a handgun to be placed in the pouch 10.

Figure 2:
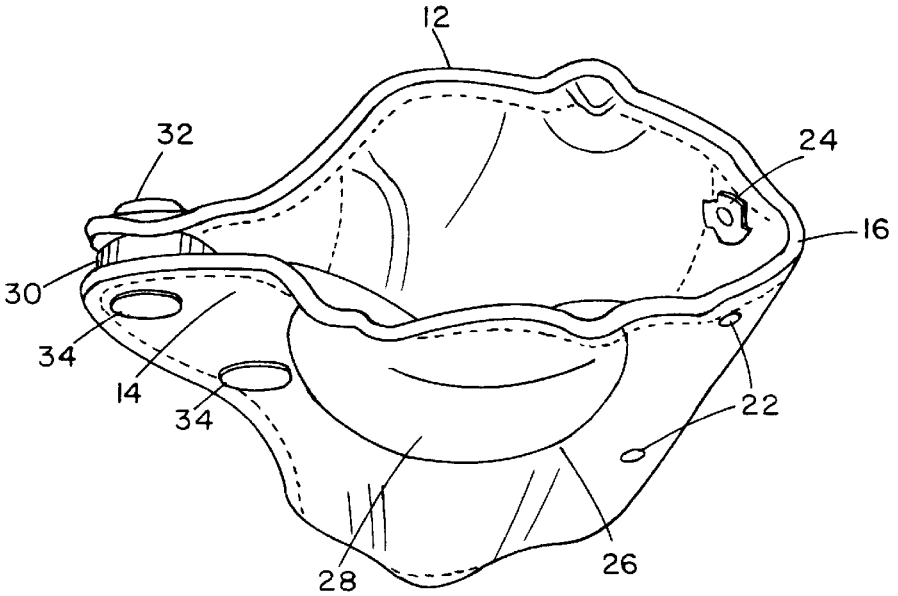
FIG. 2 is a top perspective view of the partially assembled pouch of FIG. 1.
Figure 3:
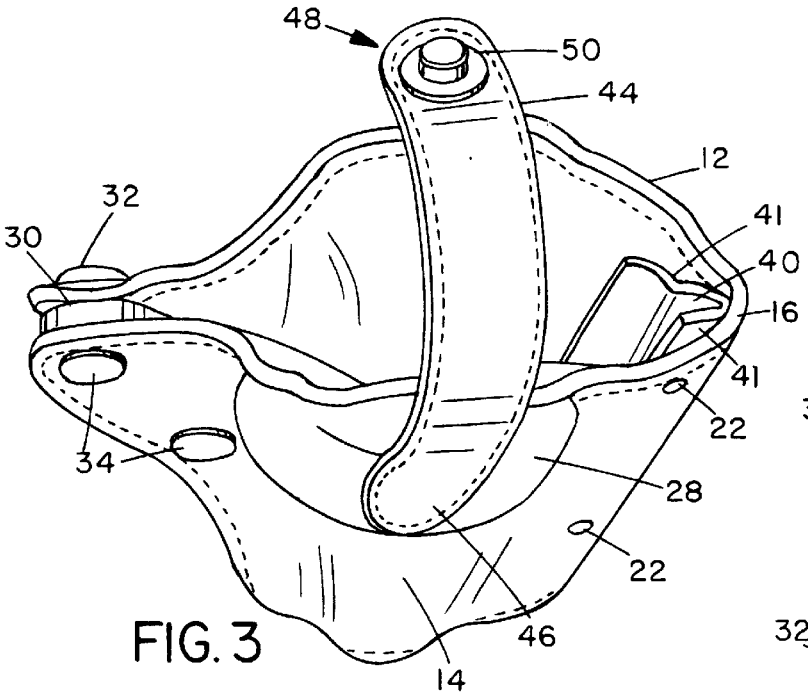
FIG. 3 is a top perspective view of the fully assembled pouch of FIGS. 1 and 2.

As is particularly shown in FIGS. 2 and 3, when side walls 12,14 are folded about central region 16 the general shape of pouch 10 is created. Either or both side walls 12,14 may have strips 28 of Velcro® attached to the outer surface thereof. They may be attached by adhesives, fasteners, ultrasonic welding, or other suitable attachment means including as shown, the use of stitching 26. The purpose of strips 28 will be described below.

When folded, there may be provided a spacing block 30 between the rear edge portions 36,38 so that the width of pouch 10 may be varied according to the requirements of the handgun to be placed therein.

Figure 4:
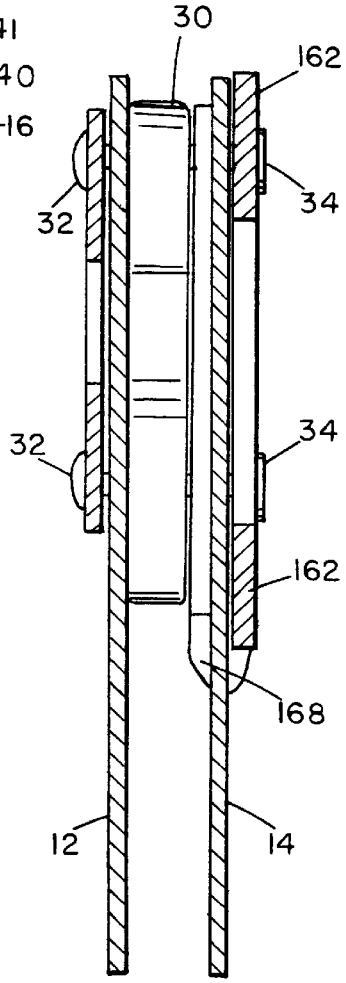
FIG. 4 is a cross-sectional view along the lines of and in the direction of arrows 4—4 of FIG. 7.
Figure 5A:
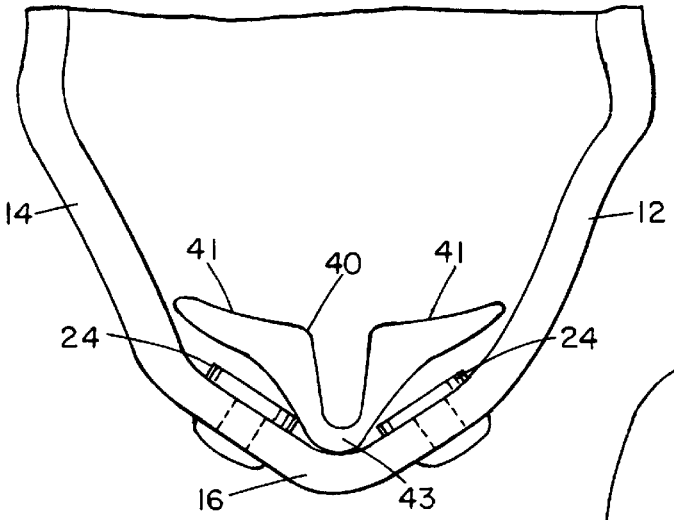
FIG. 5A is an enlarged partial view of the pouch of FIGS. 1 and 2.
Figure 5:
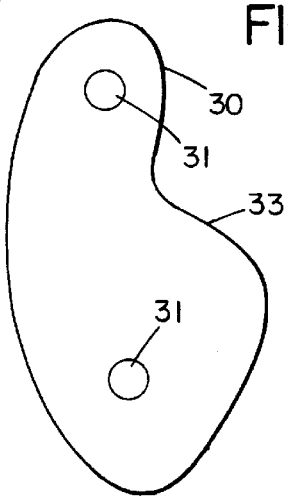
FIG. 5 is a side view of the spacing block shown in FIG. 4.

As is clear from FIGS. 4 and 5, spacing block 30 is held in place between the outer edge portions 36,38 by fasteners 32 cooperating with nuts 34. Block 30 has holes 31 therein aligned with holes 20 to enable fasteners 32 to pass therethrough. There may be a number of sets of holes 31 in block 30 to allow for different sizes or shapes of pouch 10. In this way, the one block 30 can be used with different pouches.

Block 30 is generally shaped and sized to substantially conform to the general shape and size of outer edge portions 36,38; and also has a stepped portion 33 which is shaped and sized to correspond to a trigger guard of a handgun to be inserted into pouch 10.

In particular with FIGS. 3 and 5A, there can be seen a sight guard 40 such as disclosed in U.S. Pat. No. 5,161,721 which is inserted and secured into the pouch 10 along central region 16 by stitching 42, gluing, or any other suitable means. By using stitching 42, the sight protector 40 is held in place along its apex 43 and its side panels 41 cover captive nuts 24 so that there is no contact between those captive nuts 24 and any handgun to be inserted into the pouch 10. This reduces the likelihood of damage to the handgun due to contact with the nuts 24, and also avoids the need for a separate liner or the like to be provided on the inner surface of the pouch 10 to cover the nuts 24. The removal of the requirement for a liner or the like substantially reduces manufacturing costs and complexities.

A safety strap 44 may also be provided. Such safety straps 44 are also sometimes called retainer or security straps. Safety strap 44 has a first end 46 which is provided on its inner surface with Velcro® so that it can cooperate with the panels 28 to attach the safety strap 44 to the pouch 10 in a releasable but secure manner, and in a manner that enables the safety strap 44 to be adjusted relative to the pouch 10. Advantageously, there is a panel 28 on each side panel 12,14 so that the pouch 10 can be used for right- or left-handed users. This enables the pouch to be reversible to enable a manufacturer to assemble a holster for either left- or right-hand versions with a minimum of components. The safety strap 44 has an outer end 48 which may be provided with a press-stud 50, in the usual manner. Alternatively, Velcro® or any other suitable releasable fastener may be used at the outer end 48, if desired.

Figure 6:
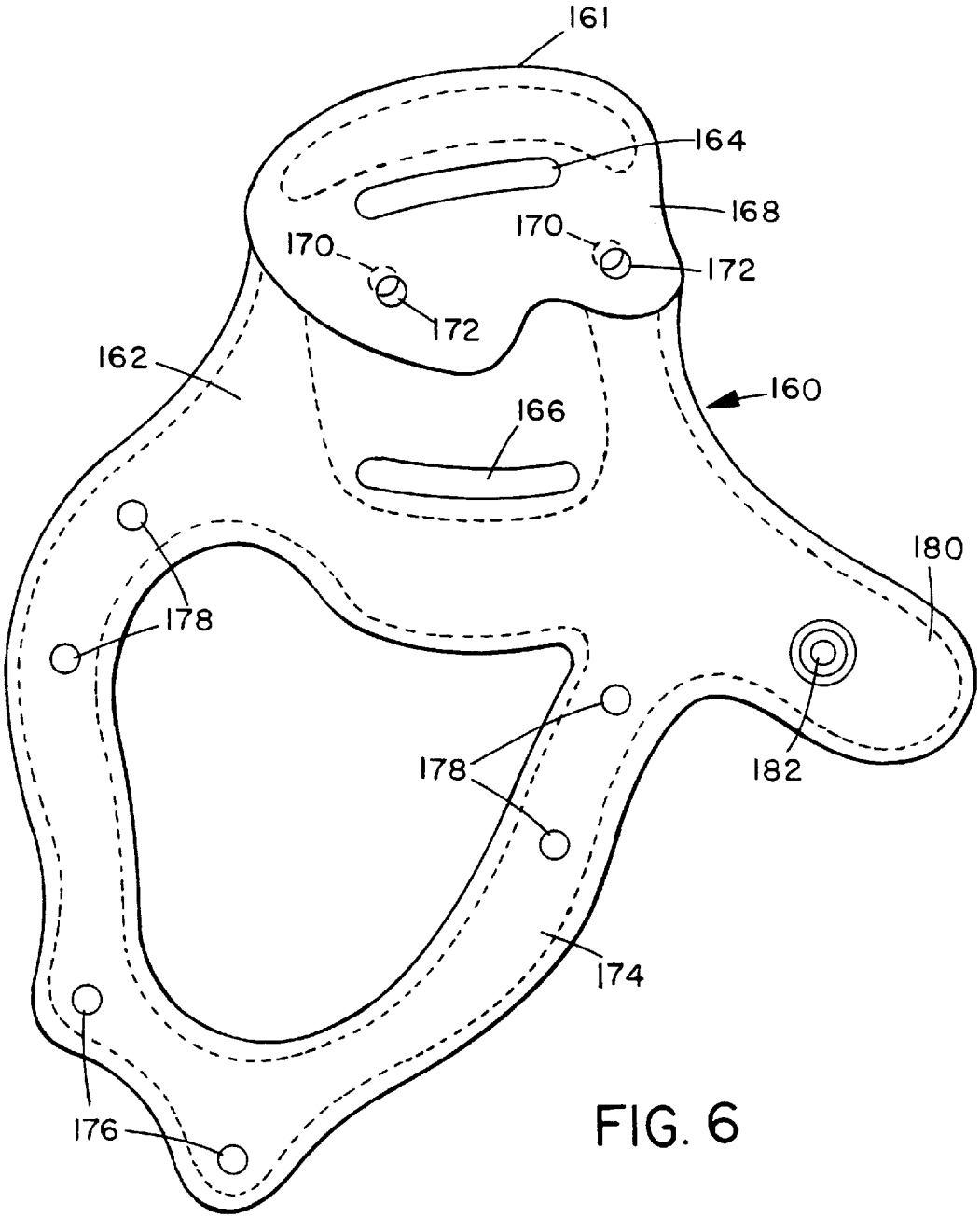
FIG. 6 is a plan view of a first form of panel according to the present invention for use with the pouch of FIG. 1–5.
Figure 7:
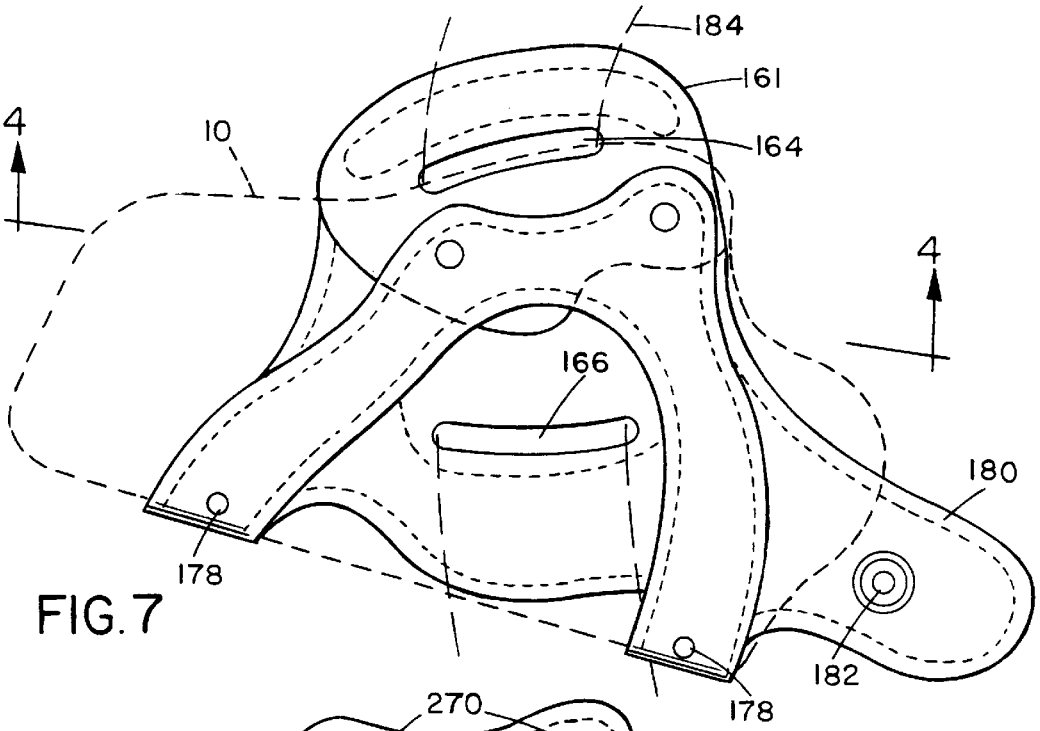
FIG. 7 is a perspective view of the panel of FIG. 6 as fitted to the pouch of FIGS. 1–5.

In FIGS. 6–21 there are illustrated a number of embodiments of panels according to the present invention. In the description and the drawings, like components will be given like reference numerals with the addition of a prefix number corresponding to the embodiment number. Thus, for example, in all figures there is an overlying panel 60 which, in FIGS. 6 and 7, is represented by a first embodiment of a panel 160 adapted to be used in conjunction with the pouch 10.

The panel 160 has a first portion 162 adapted to be held adjacent the first side wall of FIG. 3. This has an extension 161 which has a cut-out 164 which cooperates with cut-out 166 to form an integral belt loop. By having the belt loop integral, the use of a separate component is avoided.

In addition, extension 161 of portion 162 has a flap 168, also with a cut-out 164. Portion 162 has two holes 170 therein, and flap 168 has two holes 172 therein. Flap 168 is intended to be located between rear edge portions 36,38 and also beneath block 30 (if used). This is shown in FIG. 4. Holes 170,172 are located and spaced to correspond to the location and spacing of holes 20 in pouch 10 so that, when panel 160 is assembled with pouch 10, holes 170,172 align with holes 20. In this way, fasteners 32 can pass through holes 170,172 to secure both portion 162 of panel 160, and flap 168, in position. In this way, panel 160 is secured to the rear edge portion of pouch 10.

In addition, panel 160 has a second portion 174 adapted to overlay second side wall 14. Further holes 176 are provided which are located and spaced to correspond to the location and spacing of holes 20 in pouch 10 so that when second portion 174 is assembled with pouch 10 holes 176 align with first holes 20 in pouch 10, holes 170 in first portion 162, and holes 172 in flap 168, to enable second portion 174 to also be secured to the rear edge portions 36,38 of pouch 10. In addition, two sets of holes 178 are provided which are located and spaced to correspond to the location and spacing of holes 22 in pouch 10 so that when second portion assembled with pouch 10, holes 178 align with holes 22 in pouch 10. In this way, when panel 160 is folded about a line between the sets of holes 178, holes 176 align with holes 172,170,20 to enable fasteners 32 to secure them together, as shown in FIG. 4. Holes 178 are aligned with holes 22 so that fasteners (not shown) can be used to secure them together. In this way, the pouch 10 is firmly retained within panel 160. The use of flap 168 assists in this retention. Ideally, the spacing between holes 22 and holes 178 will be varied appropriately to allow proper alignment of the overlying holes 178 with holes 22.

In addition, a thumb break 180 may be provided integral with first portion 162. A female press-stud component 182 may be provided to cooperate with the male press-stud component 50 on safety strap 44 of pouch 10.

The embodiment shown in FIGS. 6 and 7 approximates that of a standard form of holster and is adapted to be worn on the belt of a wearer in the "at-the-hip" position in the usual manner. The pouch 10 is held rigidly in cooperation with panel 160 and provides for normal operation, and ease of use, by a user. By having cut-out 164 in extension 161 which extends beyond the rear edge portions 36,38 of pouch 10, when used in conjunction with a belt 184 (see FIG. 7) the rear edge portions 36,38 are drawn closely to the belt 184 to thus keep the entire holster close to the body of a wearer.

Figure 8:
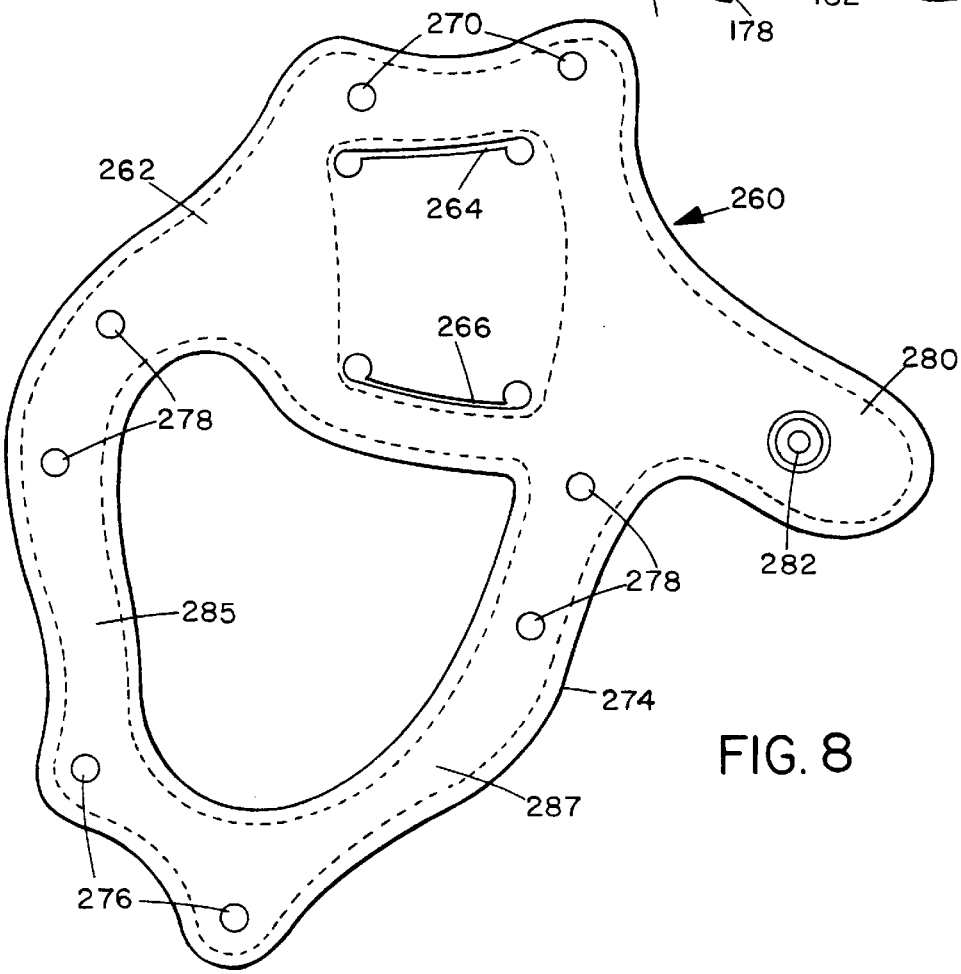
FIG. 8 is a plan view of a second form of panel according to the present invention for use with the pouch of FIGS. 1–5.
Figure 9:
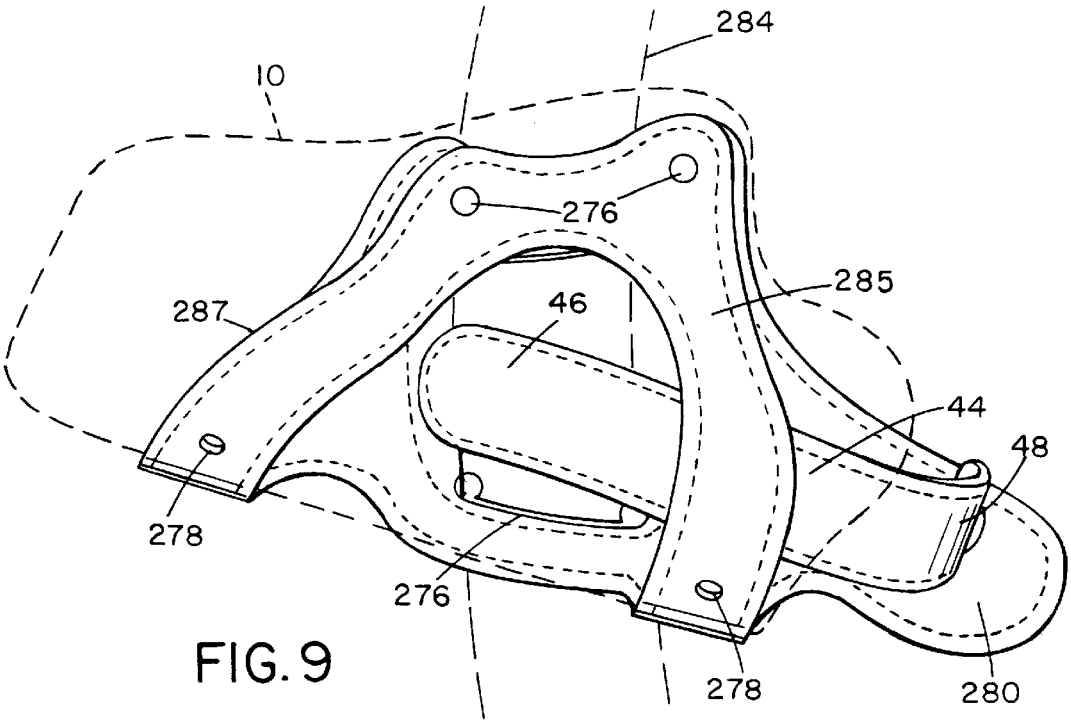
FIG. 9 is a perspective view of the panel of FIG. 8 as fitted to a pouch of FIGS. 1–5.

In FIGS. 8 and 9 there is shown a second embodiment of a panel 260 which is somewhat more basic than that of the first embodiment of FIGS. 6 and 7. Here, there is a first portion 262 having cut-outs 264,266 to form a standard form of belt loop. A first set of holes 270 which are spaced and aligned as per holes 20 are adjacent the upper edge of first portion 262. Again, first portion 262 is adapted to overlay first side panel 12 of pouch 10. Again, a thumb break 280 with a female press-stud 282 may be provided.

A second portion 274 is provided which has a pair of holes 276 which align with holes 270 and 20 in the assembled form shown in FIG. 9. Furthermore, two further sets of holes 278 are provided which align with holes 22 so that the panel 260 is secured to the pouch 10 adjacent the fold line 16. This embodiment may be less stable at the belt 284 than the embodiment of FIGS. 6 and 7, but is still effective.

As is clear from FIG. 9, not only for this embodiment but for all other embodiments illustrated and described, where there is a safety strap 44, the second portion 274 overlays safety strap 44. This is because second portion 274 has two arms 285 and 287. This is the same as the embodiment of FIGS. 6 and 7, and many of the following embodiments. As can be seen from FIG. 9, arm 287 overlays safety strap 44 so that upon panel 260 being placed in position and secured by fasteners, arm 287 holds safety strap 44 in position. By virtue of the Velcro® cooperation between first end 46 of safety strap 44 and panel 28, it is then very difficult, if not impossible, to inadvertently remove safety strap 44 without releasing fasteners 32 to remove at least arm 287 of second portion 274. In this way, great security is provided for safety strap 44, without deleting its inherent adjustability. By adding or removing safety strap 44 the end 46A of strap 46 can be extended, if desired, to be under arm 287, thereby further increasing the security of the strap 44. Furthermore, a manufacturer or user can determine whether or not a safety strap is to be used; and, if so, the tension required for the safety strap 44 to be used; and if so, its placement, and tightness over the handgun.

Furthermore, the open area formed between arms 285,287 and web 285A facilitates the adjustment of the strap 44, with no special tools required as would be in the U.S. Pat. Nos. to Wisser 5,236,113 and Beletsky 5,246,153.

This arrangement holds the cooperating Velcro® components in "shear", where the joining is strongest, and prevents them being placed into "peel" mode, where the joining is weakest.

Figure 10:
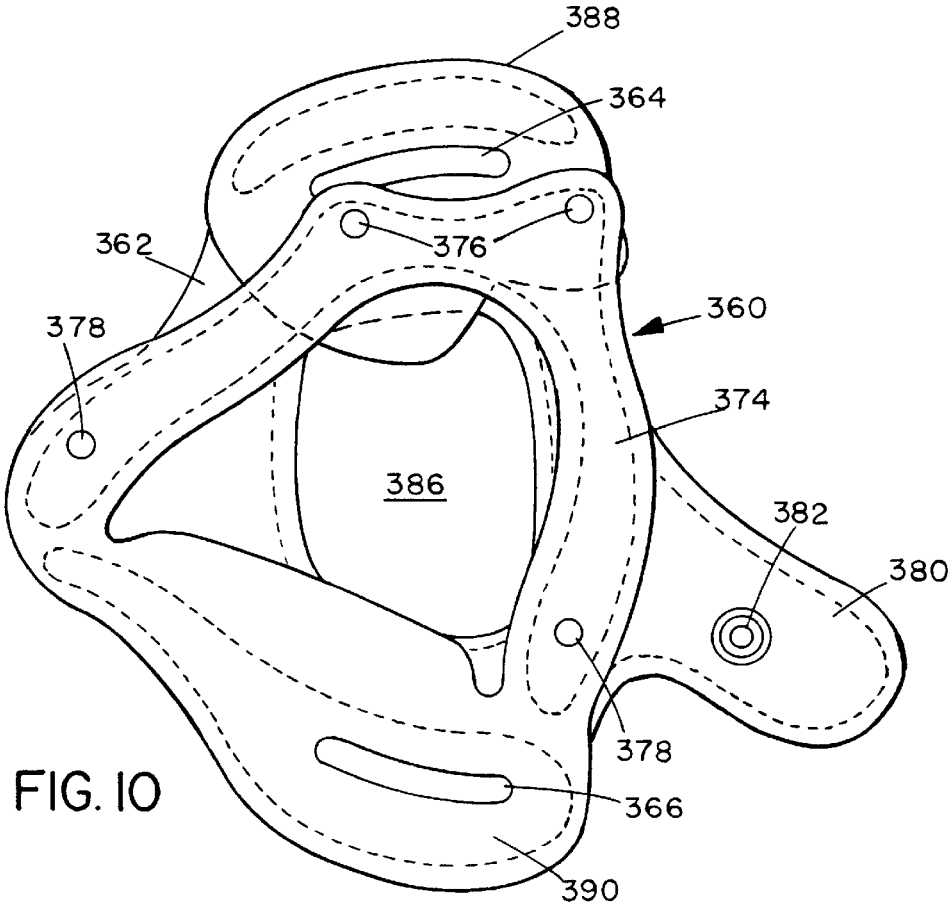
FIG. 10 is a plan view of a third form of panel for use with the pouch of FIGS. 1–5.
Figure 11A:
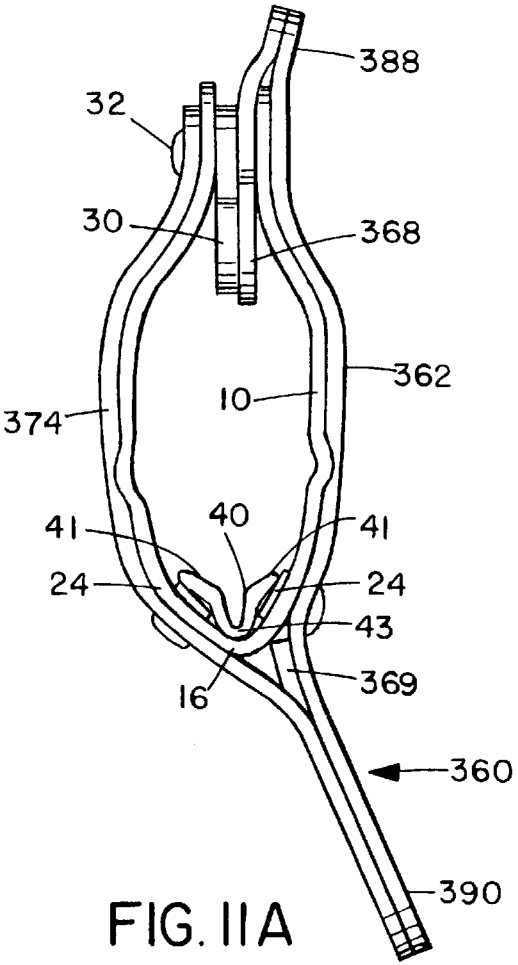
FIG. 11A is a top plan view of the overlying panel of FIGS. 10 and 11 as fitted to the pouch of FIGS. 1–5.
Figure 11:
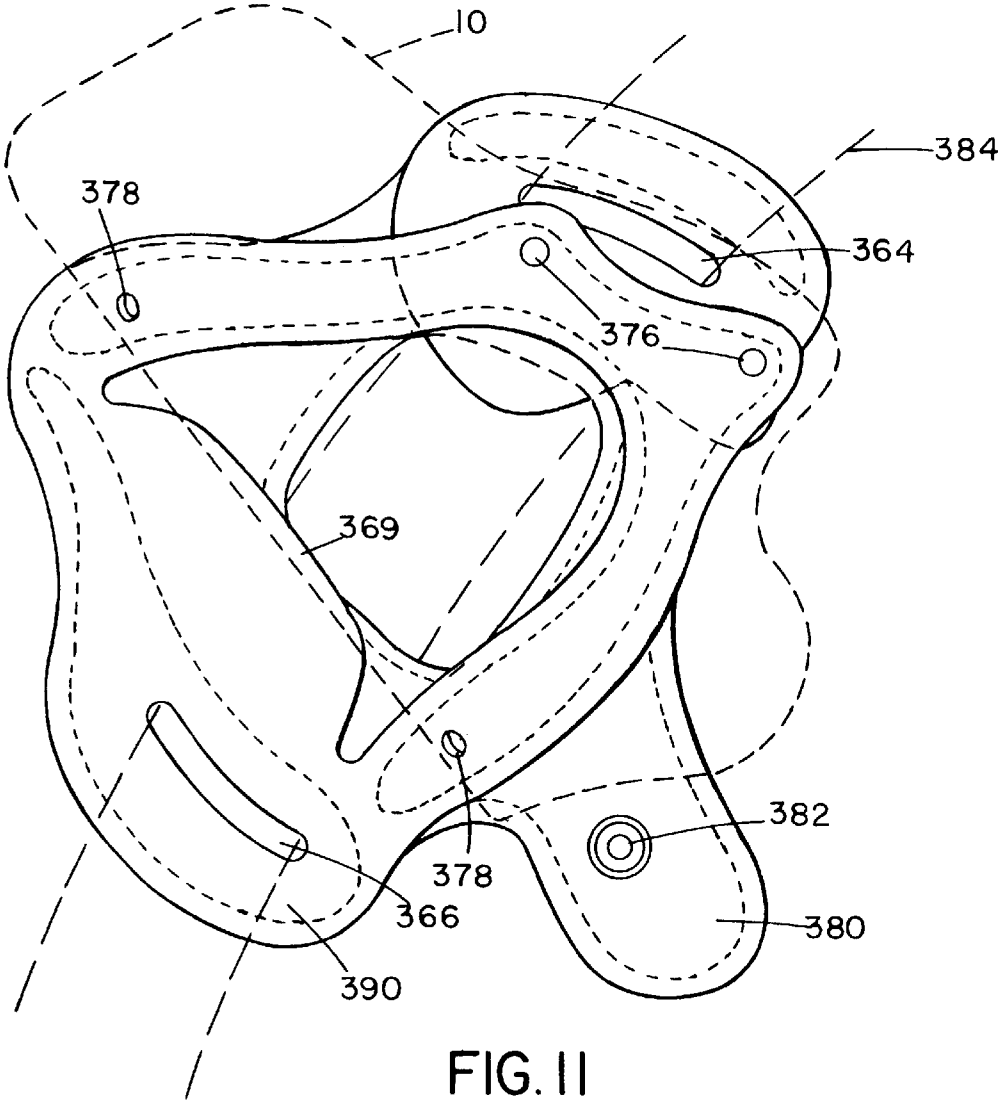
FIG. 11 is a perspective view of the panel of FIG. 10 as fitted to the pouch of FIGS. 1–5.

A third embodiment is shown in FIGS. 10, 11 and 11A. Here there is a third form of panel 360 adapted to be used in conjunction with pouch 10 to form a "pancake" holster. In this form of holster, the front and rear of the holster are worn closely to the body of a wearer to provide minimal visual intrusion when wearing a jacket, pullover, or the like.

The first portion 362 is somewhat elliptical in shape and has a central opening 386. At a first end 388 there is provided a flap 368 in the same manner as the embodiment of FIGS. 6 and 7 and which is shaped similarly to block 30. A first cut-out 364 for a belt loop is provided in both the first portion 362 and flap 368. Again, first portion 362 has holes 370 and flap 368 has holes 372, both sets of holes aligning with holes 20 in pouch 10. Flap 368 is intended to pass between rear edge portions 36,38 of pouch 10 to be secured therein by fasteners 32.

First portion 362 has a second end 390 having a belt loop cut-out 366 therein. Secured to and extending upwardly from second end 390 towards first end 388 is second portion 374. Again, second portion 374 has holes 376 which align with holes 20 in pouch 10. Second portion 374 also has holes 78 which align with holes 22 in pouch 10. In addition, first portion 362 has holes 392 which align with holes 22 of pouch 10. Flange 369 extends under pouch 10 between holes 22 thereby contributing to the offset of panel portion 380 as shown in FIG. 11A thereby encouraging the holster to lay flatter against the wearer.

A thumb break 380 with female press-stud portion 382 may be provided in the usual manner. In this way, when pouch 10 is inserted, the pouch 10 is held firmly to panel 360 both adjacent the fold line 16 as well as at the rear edge portions 36,38 to hold the pouch 10 closely into panel 360. By virtue of the distance between cut-outs 364,366, and the curvature of belt 384 when being worn, the pouch 10, and the holster in general, will be held very closely to the body of a wearer. Naturally, a safety strap may be used in conjunction with this embodiment, and would be held in position by arm 388 of second portion 374.

Figure 12:
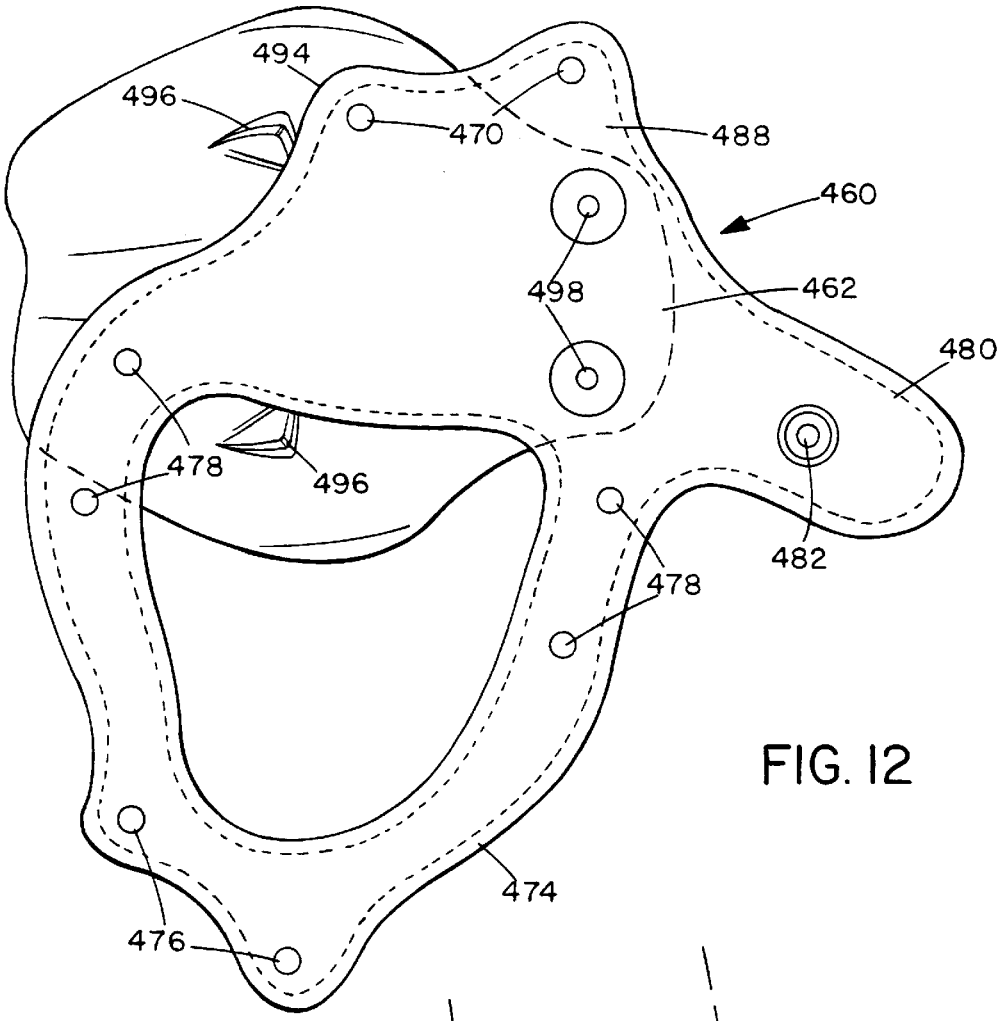
FIG. 12 is a plan view of a fourth form of panel according to the present invention for use with the pouch of FIGS. 1–5.
Figure 13:
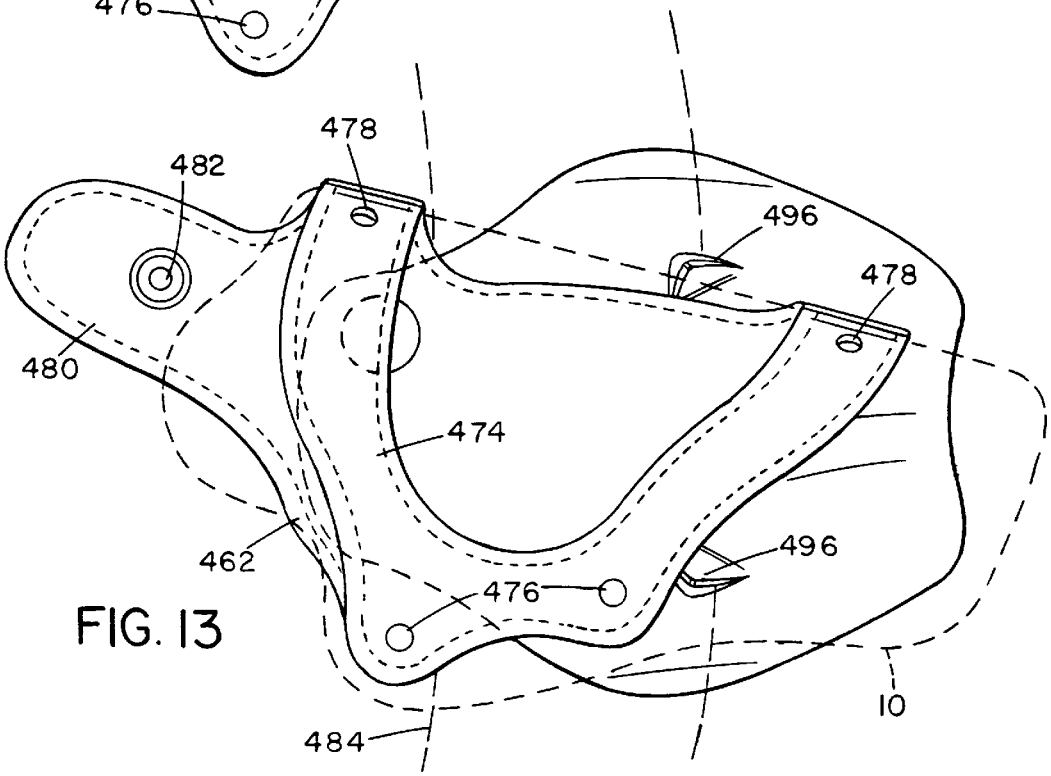
FIG. 13 is a perspective view of the panel of FIG. 12 as fitted to the pouch of FIGS. 1–5.

As illustrated in FIGS. 12 and 13 there is a fourth embodiment of panel 460. Panel 460 has a first portion 462 which, at first end 488, has openings 470 which align with holes 20 in pouch 10. Panel 460 also has a second portion 474 which has holes 476 which also align with holes 20 in pouch 10 to enable the panel 460 to be secured at the rear end portions 36,38. In addition, holes 478 are provided to enable the panel 460 to be secured to the pouch 10 at holes 22 adjacent the fold line 16. Again, a thumb break 480 with female press-stud portion 482 may be provided in the usual manner.

The difference here is that there are no separate belt loops. There is provided a paddle clip 494 of the prior art which is pressed, molded or otherwise formed to the general curvature of the human body and which is attached to first portion 462 by fasteners 498. This is done such that there is a gap between paddle clip 494 and first portion 462. In this way, once fitted over pouch 10, the assembled holster is forced vertically downwardly outside the garment of a wearer, with paddle clip 494 being located on the inside of either a belt 484, or the waistband of a garment of a wearer. As is shown in FIG. 13, it is fitted over a belt 484. The belt 484, or waistband or its equivalent, passes between paddle clip 494 and belt 484 until contact is made with the bight formed by the intersection of the paddle clip 494 and its mounting point. At this stage, the belt 484 has passed over and is thus releasably secured in place by two upwardly directed barbs 496. In this way, the assembled holster is held in position relative to belt or waistband 484 without the need of belt loops or the like. This provides for ease of removability yet the holster is held securely in position.

Figure 14:
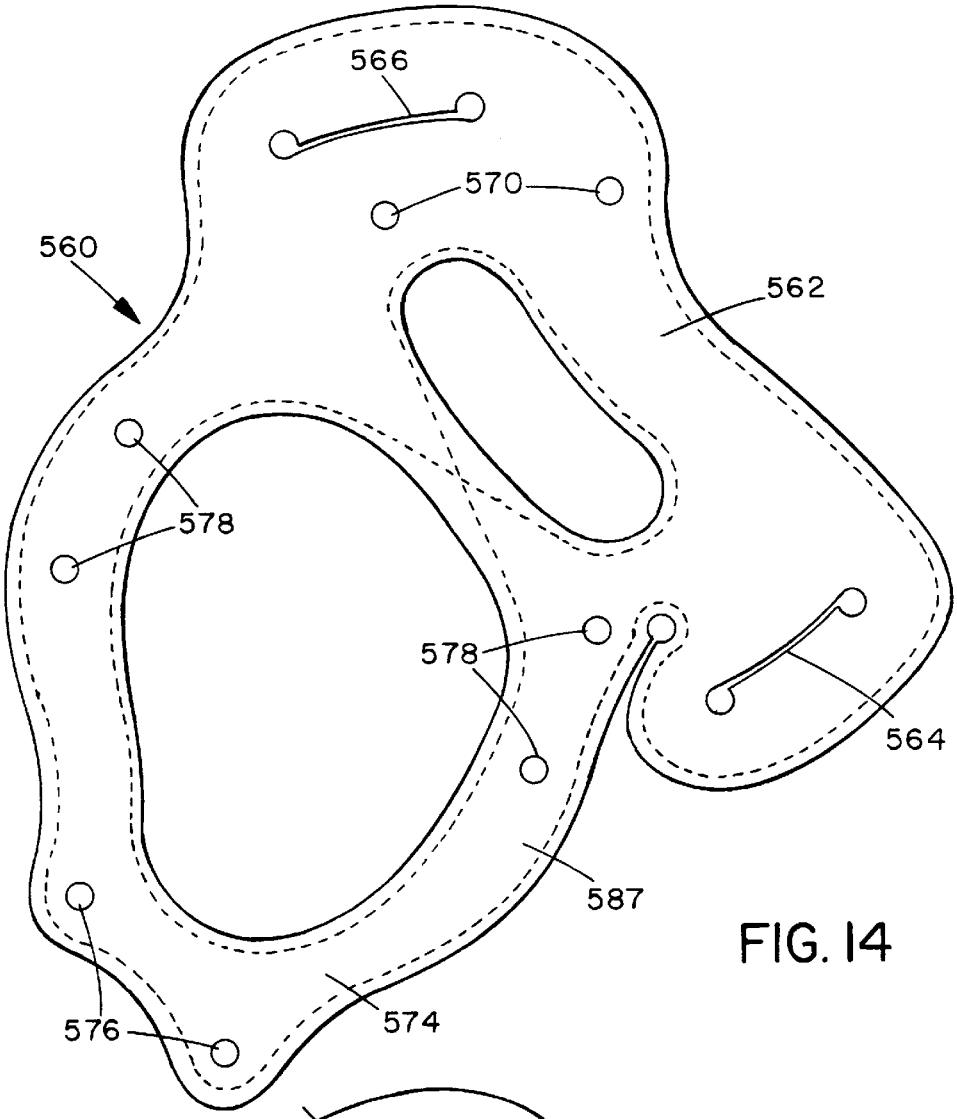
FIG. 14 is a plan view of a fifth form of panel of the present invention for use with the pouch of FIGS. 1–5.
Figure 15:
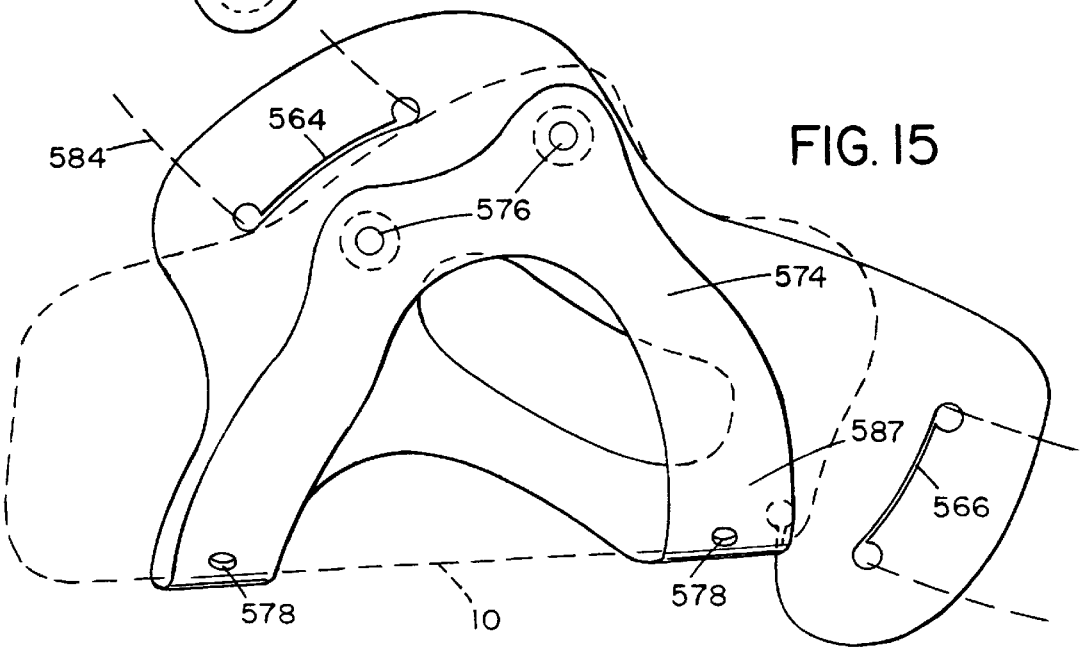
FIG. 15 is a perspective view of the panel of FIG. 14 as fitted to the pouch of FIGS. 1–5.

The embodiment of FIGS. 14 and 15 is for a specialist form of panel 560 which has a first portion 562 having belt loop cut-outs 564 and 566. First portion 562 has holes 570 which align with holes 20 in pouch 10 adjacent the rear edge portions 36,38. Panel 560 also has a second portion 574 which has holes 576 which align with holes 570 and holes 20 to enable the entire panel 560 to be releasably secured adjacent the rear edge portions 36,38 by fasteners 32.

In addition, second portion 574 has two sets of holes 578 which align with holes 22 so that the panel 560 is releasably held on either side of the fold line 16 of pouch 10.

As can be seen from FIG. 15, when the pouch 10 is assembled with panel 560, and placed on a belt 584 the pouch is angled slightly above the horizontal. This is a form of holster which is intended to be worn at the small of the back of a user and is used quite often by undercover police, or the like. In this form, it would be normal for there to be no safety strap 44. If there were, it would be held in place by arm 589 of second portion 574. As with other embodiments disclosed herein, a security strap similar to strap 44 and cooperating with thumb break 80 may be provided between pouch 10 and portion 562.

Figure 16:
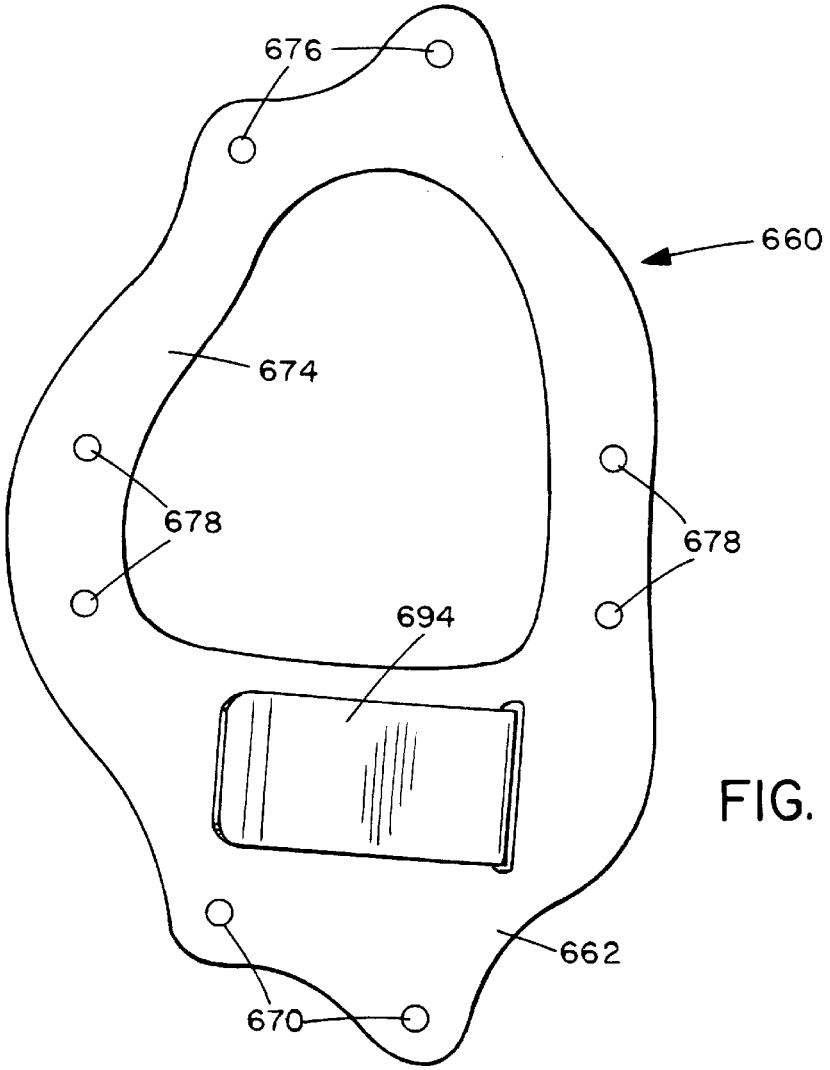
FIG. 16 is a plan view of a sixth form of panel of the present invention for use with the pouch of FIGS. 1–5.
Figure 17:
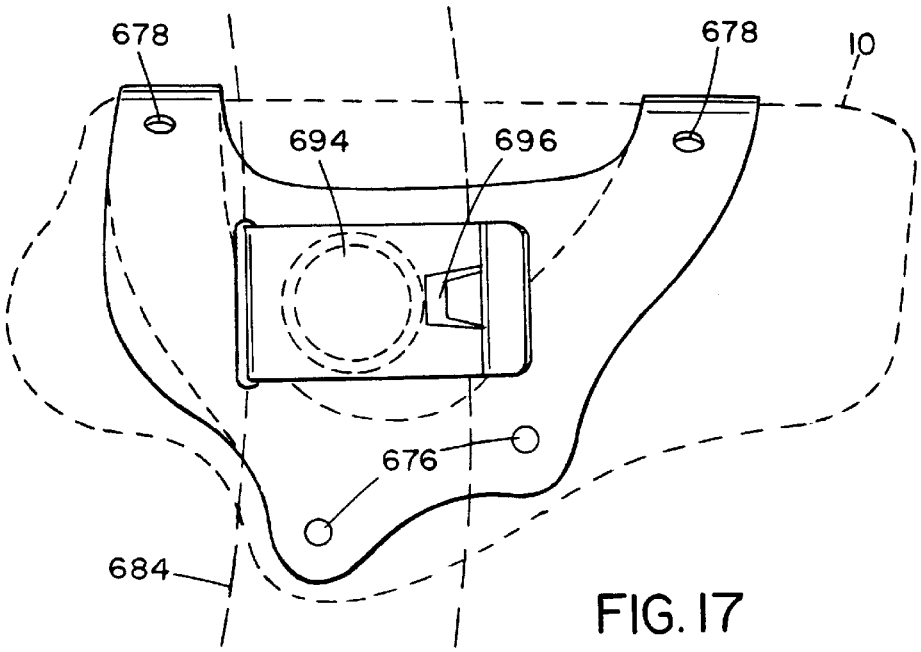
FIG. 17 is a perspective view of the panel of FIG. 16 as fitted to the pouch of FIGS. 1–5.

Illustrated in FIGS. 16 and 17 is a sixth form of panel 660 having a first portion 662 with holes 670 adapted to align with holes 20 in pouch 10 and to cooperate with fasteners 32 to hold first portion 662 in place adjacent the rear edge portions 36,38.

Panel 660 has a second portion 674 which has holes 676 which align with holes 20 in pouch 10 to secure second portion 674 by fasteners 32 adjacent the rear edge portions 36,38. In addition, there are holes 678 which align with holes 22 to enable the panel 660 to be secured either side of the fold line 16. Again, this embodiment may have retainer straps as in any of the other embodiments.

Again, here, there is not separate belt loop and instead a clip 694 is provided. This is more clearly illustrated in FIG. 17 where it can be seen that clip 694 is securely attached to first portion 662. It is adapted to be passed over a belt 684 and an upwardly directed barb 696 engage under the belt to releasably but securely retain the holster in relation to the belt 684. With this form of holster, the holster is adapted to be worn inside the trousers, skirt or other article of clothing of the wearer with only the upper portion of the holster and the clip 694 being visible though, alternatively, the holster may be suspended outside the waistband 684 by clip 694.

Figure 18:
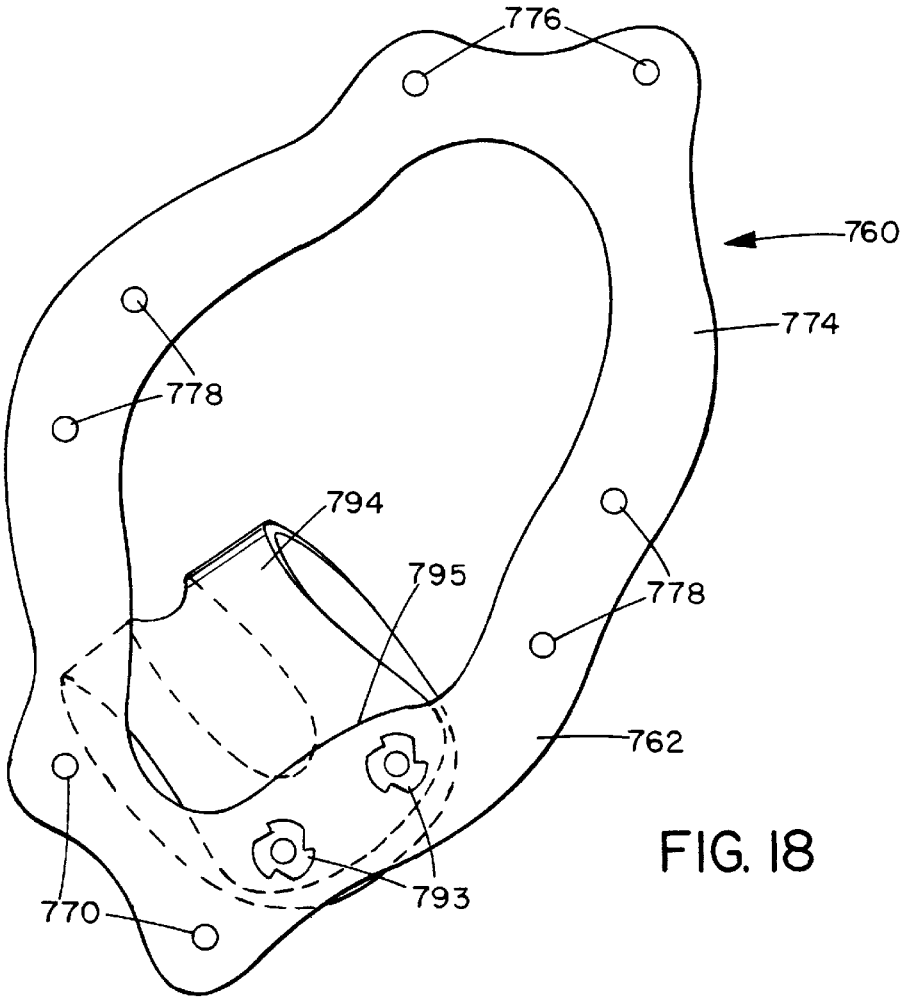
FIG. 18 is a plan view of a seventh form of panel of the present invention for use with the pouch of FIGS. 1–5.
Figure 19:
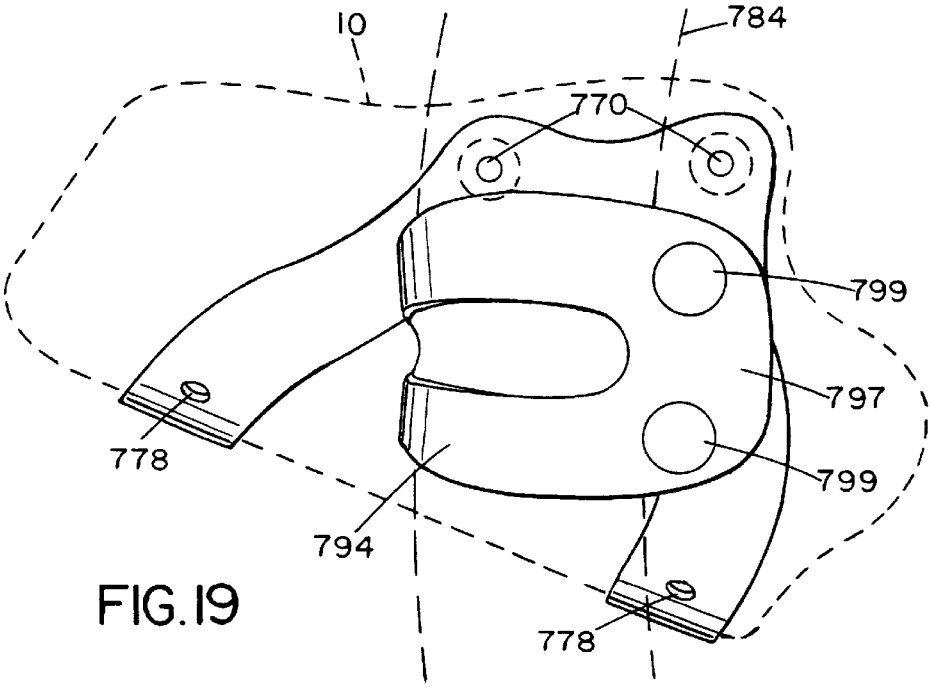
FIG. 19 is a perspective view of the panel of FIG. 18 as fitted to the pouch of FIGS. 1–5.

FIGS. 18 and 19 show a variation of this form where there is a panel 760 having a first portion 762 with holes 770 adapted to align with holes 20 in pouch 10 and to be used in cooperation with fasteners 32 to retain first portion 762 in position relative to the rear edge portions 36,38. In addition, there are the holes 778 which align with holes 22 to enable the panel 760 to be secured in position relative to and on either side of fold line 16 of pouch 10 so that the panel 760 is secured at the front leading edge of pouch 10. A second portion 774 has two openings 776 which align with holes 20 and cooperate with fasteners 32 to enable second portion 774 to be releasably secured in position relative to the rear edge portions 36,38.

Attached to first portion 762 is an alternative form of belt loop 794. This form of belt loop 794 ideally, is relatively flexible and has a first end 795 which is attached to first portion 762 by fasteners 793 or the like. At its outer end 797 it is provided with press-studs or the like 799. In this way, the open belt loop 794 can be passed around the belt 784 and then snipped closed when the holster is in position. In this way, the embodiment of FIGS. 18 and 19 works similarly to the embodiment of FIGS. 16 and 17. This embodiment is intended to suspend the holster inside the wearer's waistband.

For the embodiments of FIGS. 16–19 no safety strap is shown. One can be used, if desired. Furthermore, no thumb break is shown but if a safety strap is used, a thumb break would be provided.

Figure 21:
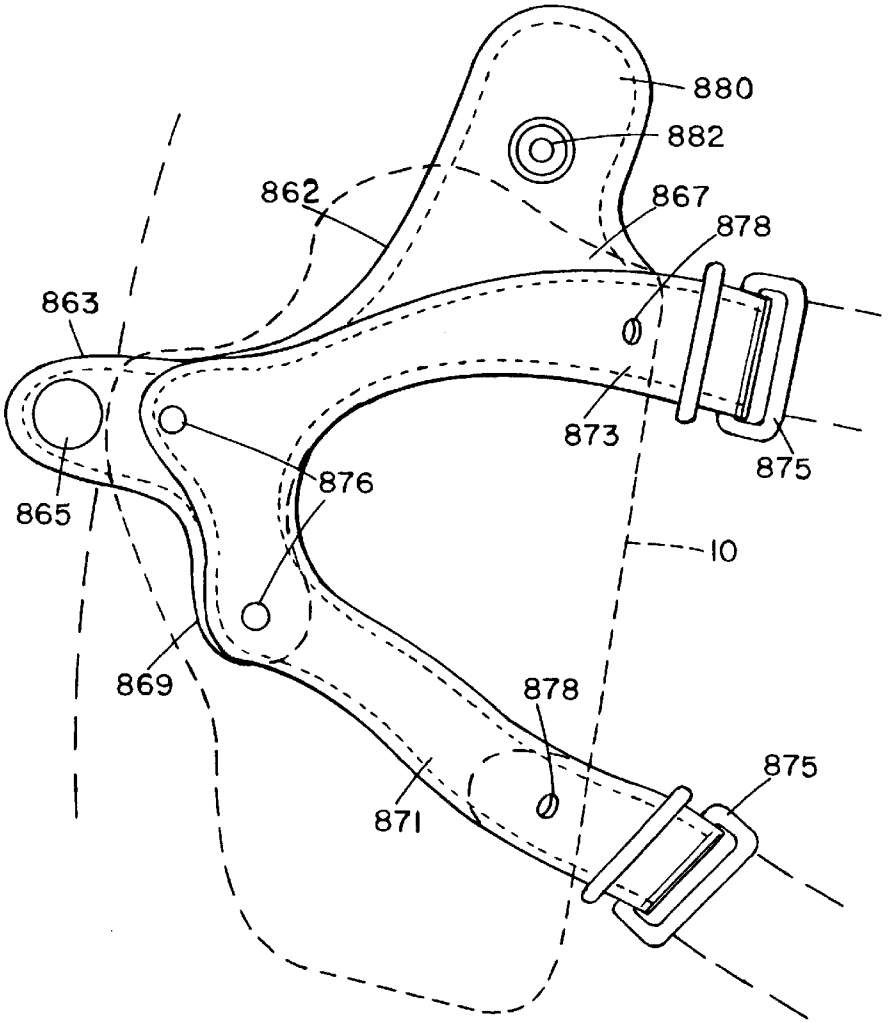
FIG. 21 is a perspective view of the panel of FIG. 20 as fitted to the pouch of FIGS. 1–5.
Figure 20:
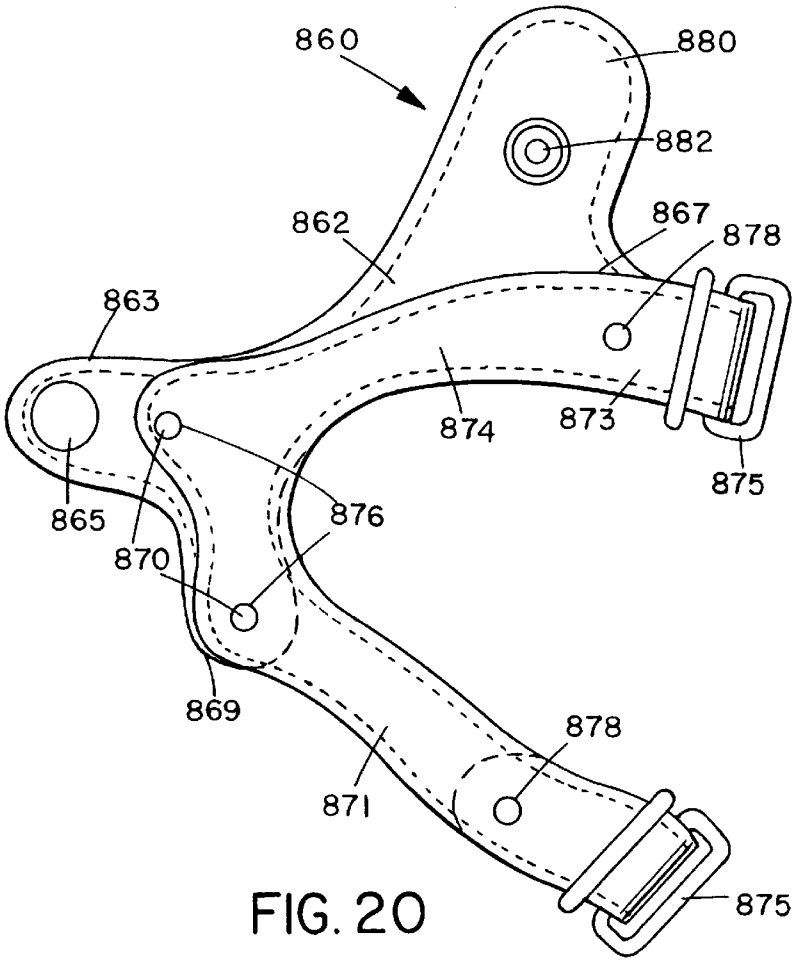
FIG. 20 is a plan view of an eighth form of panel of the present invention for use with the pouch of FIGS. 1–5.

To refer to the final embodiment as illustrated in FIGS. 20 and 21, there is shown a panel 860 to enable the assembled holster to be used in conjunction with a shoulder harness. Here, there is provided a first portion 862 which has a thumb break 880 with female press-stud component 862, as is typical. The first portion 862 also includes a projection 863 which has a male press-stud component 865. Projection 863 and press-stud 865 is adapted to be used in conjunction with a separate strap which extends from the wearer's waistband (such as for example, a belt). The first portion 862 has arms 867 and 869 which are folded back upon themselves to form second portion 874, which again has arms 871 and 873. At the folds there are located the usual loops or rings 875 to cooperate with the shoulder harness. The first portion 862 has holes 870, and second portion 874 has holes 876 with holes 870,876 aligning with holes 20 on pouch 10 to enable first portion 862 and second portion 874 to be retained by fasteners 30 adjacent the rear edge portions 36,38 of pouch 10. Both arms 867 and 869, as well as arms 871 and 873 have holes 878 which align with holes 22 in pouch 10 adjacent fold line 16 to enable panel 860 to be releasably secured to pouch 10 on either side of fold line 16.

Although not illustrated, a safety strap may be used in conjunction with pouch 10 and this would be held in place by arm 873 of second portion 874.

By the use of a range of panels 60 for the one pouch 10, a manufacturer can configure a holster to the required version immediately prior to shipping, rather than having to maintain a large inventory of assembled holsters.

The fasteners used may be nuts and bolts, rivets, or any other suitable fastener known in the art. Alternatively, gluing, sewing or any other fastening may be used. The panels 60 may be made of any suitable material, such as those described for the pouch 10, or of a different material. For example, the pouch 10 and the panels 60 may be both of a relatively stiff material, or one could be of a softer material and the other of a relatively stiff material. By way of example, the pouch 10 may be made of a relatively stiff polymer acrylic/PVC alloy known as "KYDEX" and the panel 60 of a relatively flexible elastomer such as Monsanto Co.'s "SANTOPRENE".

The second portions 74 of the panels 60 preferably all have a form of cut-out, or are comprised of two spaced apart arms, to retain within the panel 60 the pouch 10 but without exerting undue pressure on the pouch 10 to thus make insertion and withdrawal of the handgun more difficult than desirable. This is as shown in all embodiments illustrated and described. The panels 60 in the embodiments described are not intended to provide a handgun retention function although this can be achieved if desired.

If desired, part of the panel 60 may be integral with the pouch 10. For example, the second portion 74 could be integral with panel 14. Alternatively, either or both portions 62,74 could be securely attached to the respective panels 12,14 by stitching, riveting, welding, gluing, or any other permanent or semi-permanent means.

Whilst there have been described in the foregoing description various embodiments of holsters for handguns incorporating the principal features of the present invention, it will be understood by those skilled in the technology concerned that many variations or modifications and details or design of construction may be made without departing from the essential nature of the present invention.

I claim:

1. A holster for a handgun, comprising:

a pouch adapted to releasably receive therein a handgun, the pouch having a first side wall, a second side wall, the side walls each having a rear edge portion, and a central wall portion connecting the side walls together;

a panel adapted to pass around the pouch;

at least one first fastener fastening the rear edge portions of the side walls together and attaching the panel to the pouch;

at least one second fastener located adjacent the central wall portion of the pouch and attaching the panel to the pouch, the second fastener having an inner end on the inside of the pouch; and a strip secured along the central wall portion on the inside of the pouch, the strip having a portion covering the inner end of the second fastener.

2. The holster as claimed in claim 1, wherein the strip comprises a sight guard strip having a groove for receiving the sight of a handgun inserted in the pouch.

3. The holster as claimed in claim 1, including two first fasteners.

4. The holster as claimed in claim 1, including four second fasteners.

5. The holster as claimed in claim 1, wherein the panel has at least one attachment means for attaching the pouch to a user.

6. The holster as claimed in claim 5, wherein the panel has at least two spaced cut-outs for receiving a belt threaded through the cut-outs to suspend the pouch and panel from the belt.

7. The holster as claimed in claim 6, wherein the panel has three spaced cut-outs for receiving a belt.

8. The holster as claimed in claim 5, wherein the attachment means comprises a paddle member attached to the panel for hooking over a wearer's waistband or belt.

9. The holster as claimed in claim 5, wherein the attachment means comprises a spring clip attached to the panel for attachment to a wearer's belt.

10. The holster as claimed in claim 5, wherein the attachment means comprises a belt loop secured to the panel for receiving a belt threaded through the loop.

11. The holster as claimed in claim 5, wherein the attachment means comprises a pair of rings secured to the panel for attachment to a shoulder harness.

12. The holster as claimed in claim 1, wherein the panel includes a first portion extending over the first side wall of the pouch, a second portion extending over the second side wall of the pouch, and a connecting portion connecting the first and second portions together at the central portion of the pouch.

13. The holster as claimed in claim 12, wherein the connecting portion comprises a fold extending over the central portion of the pouch.

14. The holster as claimed in claim 12, wherein the connecting portion comprises first and second extensions of the first and second portions, respectively, the first extension overlying the second extension and extending outwardly from said central portion of the pouch, and securing means securing the first and second extensions together.

15. The holster as claimed in claim 12, wherein the panel has an opening extending over at least part of the second portion overlying the second side wall of the pouch.

16. The holster as claimed in claim 15, wherein the opening extends over part of the first and second portions of the panel.

17. The holster as claimed in claim 12, wherein the first portion of the panel has a flap located between the rear edge portions of the pouch, the first fastener fastening said flap between the rear edge portions.

18. The holster as claimed in claim 17, wherein the first portion of the holster has a pair of first slots, one slot of said fist pair being located on said flap, and said panel includes a second slot spaced from the first pair of slots, the first pair of slots being aligned when said flap is secured between the rear edge portions of the pouch, and said first pair of slots and said second slot comprising belt loop means for receiving a belt threaded through said slots to secure said pouch to said belt.

19. The holster as claimed in claim 12, wherein a thumb break is formed integrally with the first portion of the panel.

20. The holster as claimed in claim 12, wherein the pouch has an open upper end for receiving a handgun, and further including a safety strap for extending over the open upper end of the pouch, and a third fastener for releasably securing one end of the safety strap to the second side wall of the pouch.

21. The holster as claimed in claim 20, wherein the first side portion has a thumb break, the thumb break and opposite end of the safety strap having interengageable fastener means for releasably securing the opposite end of the strap to the thumb break.

22. The holster as claimed in claim 20, wherein the second portion of the panel overlies the safety strap.

23. The holster as claimed in claim 22, wherein the second portion of the panel has an opening defining two arms, and one of said arms overlies the safety strap, the opening comprising access means for allowing adjustment of the strap end position.

24. The holster as claimed in claim 12, wherein the first and second portions of the panel each have an opening.

25. The holster as claimed in claim 12, wherein the rear edge portion of each side wall of the holster has at least one first hole aligned with a corresponding first hole in the other rear edge portion, and the first and second portions of the panel each have at least one first hole aligned with the first holes of said rear edge portions when said panel is wrapped around said pouch, said aligned first holes comprising means for receiving said first fastener.

26. The holster as claimed in claim 25, wherein each side wall of the holster has at least one second hole adjacent said central portion, and the first and second portions of the panel each have at least one second hole for alignment with the second hole on the first and second side walls, respectively, said aligned second holes comprising means for receiving said second fastener.

27. The holster as claimed in claim 26, including at least two second fasteners, one of said second fasteners extending through the aligned second holes in said first portion and first side wall, and the other of said second fasteners extending through the aligned second holes in said second portion and second side walls.

28. The holster as claimed in claim 26, wherein said first and second side walls each have a pair of first holes and a pair of second holes, and the first and second portions of the panel each have a pair of first holes for alignment with the pair of first holes in said pouch side walls, and a pair of second holes for alignment with the pair of second holes in the respective underlying side wall of the panel, a pair of first fasteners extending through the respective aligned first holes, and at least one pair of second fasteners extending through the respective aligned second holes.

29. The holster as claimed in claim 12, wherein the first portion of the panel has at least one attachment means for securing the panel and pouch to an item worn by a user.

30. The holster as claimed in claim 1, wherein the central portion and side walls of the pouch are formed integrally and the central portion comprises a fold.

31. The holster as claimed in claim 1, including a spacer block positioned between the rear edge portions of the first and second side walls of the pouch, and the first fastener further comprising means securing the spacer block to the rear edge portions of the first and second side walls.

32. The holster as claimed in claim 1, wherein the fasteners are threaded.

33. A holster and panel assembly, comprising:

a pouch adapted to releasably receive therein a handgun, the pouch having a first side wall, a second side wall, the side walls each having a rear edge portion, and a central wall portion connecting the side walls together;

a plurality of panels for selective attachment to the pouch, each panel being adapted to pass around the pouch;

at least one first fastener fastening the rear edge portions of the pouch together and attaching a selected panel to the pouch;

at least one second fastener located adjacent the central wall portion of the pouch and attaching the selected panel to the pouch; and each panel having means for securing the pouch to the user.

34. The assembly as claimed in claim 33, wherein the panels comprise a first panel having securing means for suspending the panel from a wearer's waistband or belt, a second panel having securing means for attaching the panel to a shoulder harness, and a third panel having securing means for threading over a wearer's belt.

35. The assembly as claimed in claim 34, wherein the securing means of the first panel comprises a paddle member attached to the panel for hooking over a wearer's belt.

36. The assembly as claimed in claim 34, wherein the third panel has at least two spaced cut-outs comprising said securing means for receiving a wearer's belt.

37. The assembly as claimed in claim 34, wherein the securing means of the first panel comprises a spring clip attached to the panel.

38. The assembly as claimed in claim 34, wherein the securing means of the third panel comprises a belt loop secured to the panel.

* * * * *